US006553674B1

(12) United States Patent
Budrow

(10) Patent No.: US 6,553,674 B1
(45) Date of Patent: Apr. 29, 2003

(54) UTILITY KNIFE THAT PROTRUDES A BLADE FROM A STORED STACK OF BLADES

(75) Inventor: William B. Budrow, Long Beach, CA (US)

(73) Assignee: AWI Acquisition Company, Sylmar, CA (US)

( * ) Notice: Subject to any disclaimer, the term of this patent is extended or adjusted under 35 U.S.C. 154(b) by 2 days.

(21) Appl. No.: 10/035,898

(22) Filed: Dec. 19, 2001

(51) Int. Cl.[7] ..... B26B 1/08
(52) U.S. Cl. ..... 30/162; 30/125; 30/335
(58) Field of Search ..... 30/125, 162, 335

(56) References Cited

U.S. PATENT DOCUMENTS

| | | | |
|---|---|---|---|
| 2,172,072 | A | 9/1939 | Rothschild |
| 3,577,637 | A | 5/1971 | Braginetz |
| 3,660,896 | A | 5/1972 | Umholtz |
| 4,005,525 | A | 2/1977 | Gringer |
| 4,242,795 | A | 1/1981 | Rollband et al. |
| 4,277,888 | A | 7/1981 | Szabo |
| 4,517,741 | A | 5/1985 | Castelluzzo |
| 4,586,256 | A | 5/1986 | Weimann |
| 4,941,260 | A | 7/1990 | Castelluzzo |
| 5,025,558 | A | 6/1991 | Gilbert |

*Primary Examiner*—Allan N. Shoap
*Assistant Examiner*—Isaac Hamilton
(74) *Attorney, Agent, or Firm*—Jack C. Munro

(57) ABSTRACT

A utility knife which has a slidable blade carrier located within an internal chamber of a housing. When the blade carrier is extended it has mounted thereon an engaging block with this engaging block being biased by a single spring to an outer engaging position which will connect the engaging block with the innermost blade of the stack of blades and sliding movement of the blade carrier will result in that innermost blade to protrude from the housing. The engaging block is mounted by a pair of pins which are mounted on the blade carrier. Movement of the blade carrier is accomplished by a thumb button where the inner portion of the thumb button is laterally displaced from the outer portion of the thumb button in order to maximize the space within a blade storage chamber formed within the housing.

4 Claims, 4 Drawing Sheets

UTILITY KNIFE THAT PROTRUDES A BLADE FROM A STORED STACK OF BLADES

BACKGROUND OF THE INVENTION

1. Field of the Invention

This invention relates to knives that have thin replaceable blades with an innermost blade of a stack of blades being able to protrude from the housing of the knife.

2. Description of the Related Art

There is substantial prior art in the designing of utility knives that include a quantity of stored blades. The knife can be activated to release a dull blade which will then permit insertion of a separate sharp blade in a usable position. In the past, the mechanical structure that is used to cause protruding of a blade that is to be used has not been designed well enough to make the operation of the extending and retracting of the blade and removing and dispensing of the used blade with replacement of a new blade in such a manner that permits ease of operation. Also, such utility knives of the prior art have not been designed in a manner that facilitates the maximizing of the size of the blade storage chamber within the knife in order to increase the number of stored blades within the knife.

SUMMARY OF THE INVENTION

A basic embodiment of utility knife where the innermost blade is to be extendable from a stored stack of blades which utilizes a housing having an internal chamber. A blade track is mounted within the internal chamber. A blade carrier is mounted within the blade track. The blade carrier is movable in a linear direction between an extended position and a retracted position. The blade carrier is to contain a single blade (the innermost blade) with this blade to protrude from the housing when the blade carrier is in the extended position. A thumb button is connected to the blade carrier with the thumb button to be slidingly movable to cause the blade carrier to move between the retracted position and the extended position. An engaging block is mounted on the blade carrier with the engaging block being movable between an engaging position and a non-engaging position. With the engaging block in the engaging position, a single blade, which comprises the innermost blade of the stack of blades, is engaged by the engaging block and is movable along with the blade carrier between the extended position and the retracted position. A pair of mounting pins are mounted on the blade carrier. The engaging block is movably mounted on the mounting pins. The engaging block being biased by a single spring toward the engaging position. A release button is mounted on the housing. Pressing of the release button when the blade carrier is in the extended position will cause the engaging block to be moved against the spring that connects with the engaging block to move the engaging block to the non-engaging position which will permit extraction of the dull innermost blade from the housing and replacement of that blade by a new sharp innermost blade.

A further embodiment of the present invention is where the basic embodiment is modified by a line connecting between the mounting pins being not in alignment with the linear direction. This misalignment of the mounting pins prevents the engaging block from canting relative to the blade carrier so as to be movable smoothly and evenly by the spring relative to the blade carrier to insure that the engaging block will properly engage with the innermost blade.

A further embodiment of the present invention is where the basic embodiment is modified by the thumb button having an inner portion with the inner portion being mounted within a receiving chamber formed in the blade carrier. The inner portion is laterally displaced from the outer portion of the thumb button in order to maximize the space within the blade storage chamber.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
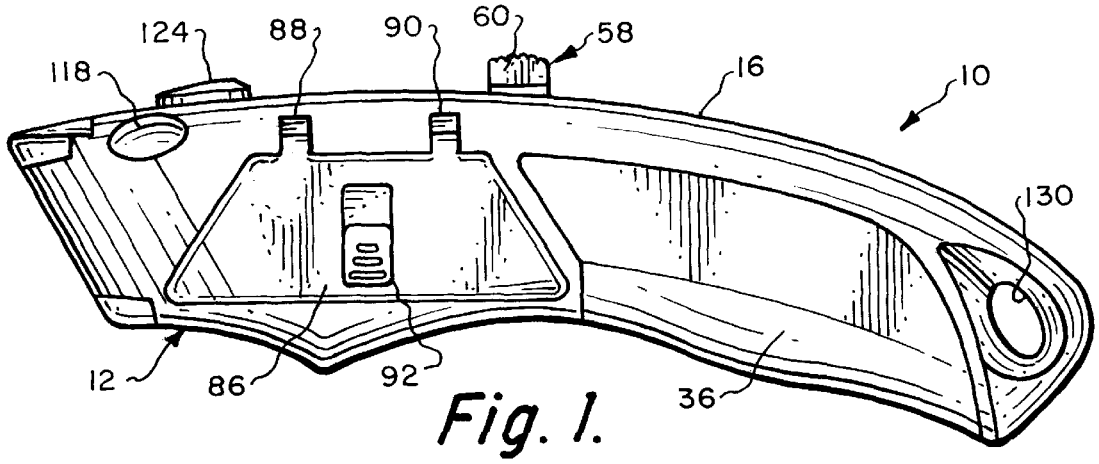
FIG. 1 is a side elevational view of a utility knife constructed in accordance with the present invention showing an innermost blade contained within the utility knife in a retracted position.
Figure 2:
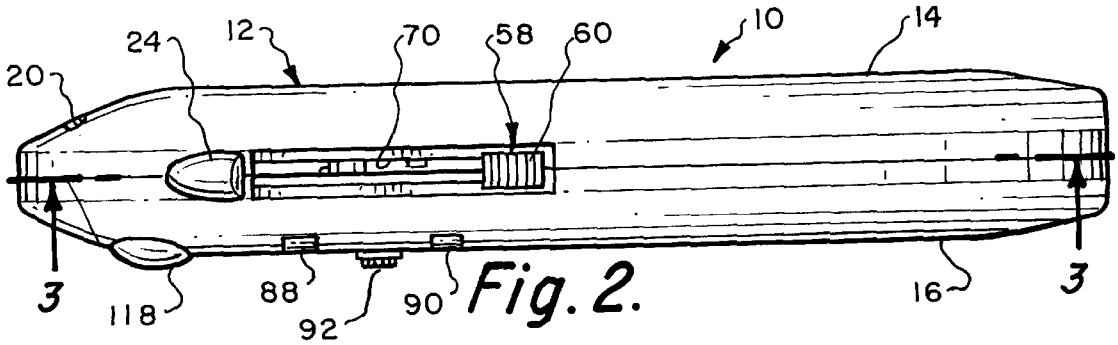
FIG. 2 is a top plan view of the utility knife of FIG. 1.

Referring particularly to the drawings, there is shown the utility knife 10 of this invention. The utility knife 10 has a housing, 12 which is composed of a housing part 14 and housing part 16. Each of the housing parts 14 and 16 are basically hollow so that when assembled together in an essentially mirror image facing relationship there is formed an internal chamber 18. Housing parts 14 and 16 are to be secured together enclosing internal chamber 18 by means of set screw 20 which is passed through hole 24 of handle part 14 and threadably engages with hole 26 of housing part 16. A bolt fastener 22 is conducted through hole 28 of housing part 16 and hole 30 of housing part 14 and is threadably secured with nut 32. The outer exterior surf ace of the housing part 14 is covered by an elastomeric covering 34 for appearance and for comfort with a user's hand. A similar elastomeric covering 36 is located against the exterior rear surface of the housing part 16.

Figure 5:
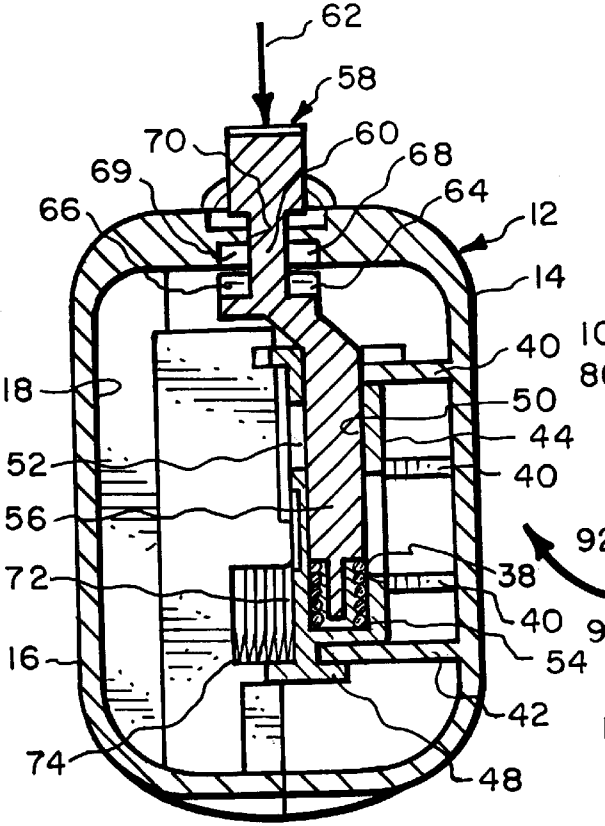
FIG. 5 is a cross-sectional view similar to FIG. 4 but showing the thumb button assembly in a depressed position.
Figure 4:
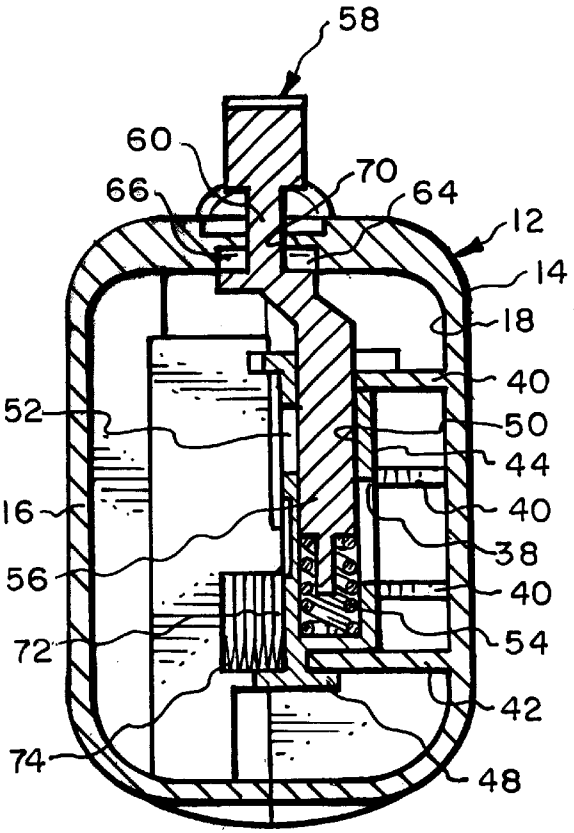
FIG. 4 is a transverse cross-sectional view through a thumb button assembly associated with the utility knife of the present invention taken along 4—4 of FIG. 3 showing the thumb button assembly in a raised position.

Within the internal chamber 18, the housing part 14 has a blade track 38 which is formed by the front surface of parallel spaced apart wall strips 40 and a bottom wall strip 42. Bottom wall strip 42 is wider than wall strips 40 so the bottom wall strip 42 will provide a bottom surface on which the blade carrier 44 is to rest. The blade carrier 44 includes a channel 46 within which is mounted an outer edge of the bottom wall strip 42. The blade carrier 44 is capable of free sliding movement within the blade track 38. The bottom flange 48 is to extend outwardly from the blade carrier 44. The blade carrier 44 also has a receiving chamber 50. Access to the receiving chamber 50 is achieved by viewing hole 52 formed within the blade carrier 44. The receiving chamber 50 is to be closed at the bottom end and is to have mounted therein a coil spring 54. The coil spring 54 is to connect with the inner portion 56 of a thumb button 58. Thumb button 58 has an outer portion 60 which is integral with inner portion 56. The longitudinal center axis of the inner portion 56 is longitudinally spaced from the longitudinal center axis of the outer portion 60. The thumb button 58 is mounted to and carried by the blade carrier 44. The thumb button 58 is also depressible as indicated by arrow 62 in FIG. 5 which will function to compress the coil spring 54. The outer portion 60 includes protuberances 64 and 66. Protuberance 64 is to be engageable with any one of a series of three notches 68. Notches 68 are formed within the housing part 14 and specifically at the sidewall of a slot 70. There is to be a similar series of notches 69 formed within the housing part 16. Each notch 69 is to be laterally aligned with a notch 68. The bias of the coil spring 54 will function to locate the protuberances 64 and 66 within an aligned pair of notches 68 and 69. Housing part 16 also has a cut-out area that forms part of the slot 70.

The blade carrier 44 is adapted to support an innermost knife blade 72. The innermost knife blade 72 is associated with a stack 74 of blades. Each of the blades 72 and 74 has an upper edge which includes a pair of notches 76 and 78. The notches 76 and 78 are to respectively connect with guide ribs 80 and 82 formed within the housing part 16 which functions to hold the blades 72 and 74 in a precise stack. The guide ribs 80 and 82 are formed within a blade storage chamber 84. As many as eight or ten of the blades 74 can be stored within the storage chamber 84. The access into the storage chamber 84 can be obtained by means of a door 86 which is pivotally mounted by means of hinge connections 88 and 90 to the housing part 16. The door 86 can be pivoted between an open and a closed position, and when in the closed position the door 86 is to be latched by a pawl 93 which engages with housing part 16. The pawl 93 is integral with manually slidable latch 92 mounted within door 86. The latch 92, when slid to the position unlatching pawl 93 from housing part 16, moves against coil spring 95. Manual sliding of the latch 92 is to result in unlatching of the door 86 so that it can be pivoted to the open position. Mounted on the inside surface of the door 86 is a leaf spring 94. The leaf spring 94 is to abut against the stack 74 of the knife blades. Therefore, when the door 86 is closed, a spring bias is applied against the stack 74 to make sure that the innermost blade 72 is located in abutting contact with the blade carrier 44.

The blade carrier 44 includes a recess 96. The recess 96 includes a back wall 98 on which is fixedly mounted a pair of mounting pins 100 and 102. If a line was made to interconnect the pins 100 and 102, that line would not be parallel to the wall strip 42 which means that it is also not parallel to the lineal direction of movement of the innermost knife blade 72 as it is moved between the retracted position, shown in FIG. 3 and totally confined within the internal chamber 18, and the extended position where the front edge of the knife blade 72 will protrude from the front opening 104 of the housing 12.

Figure 7:
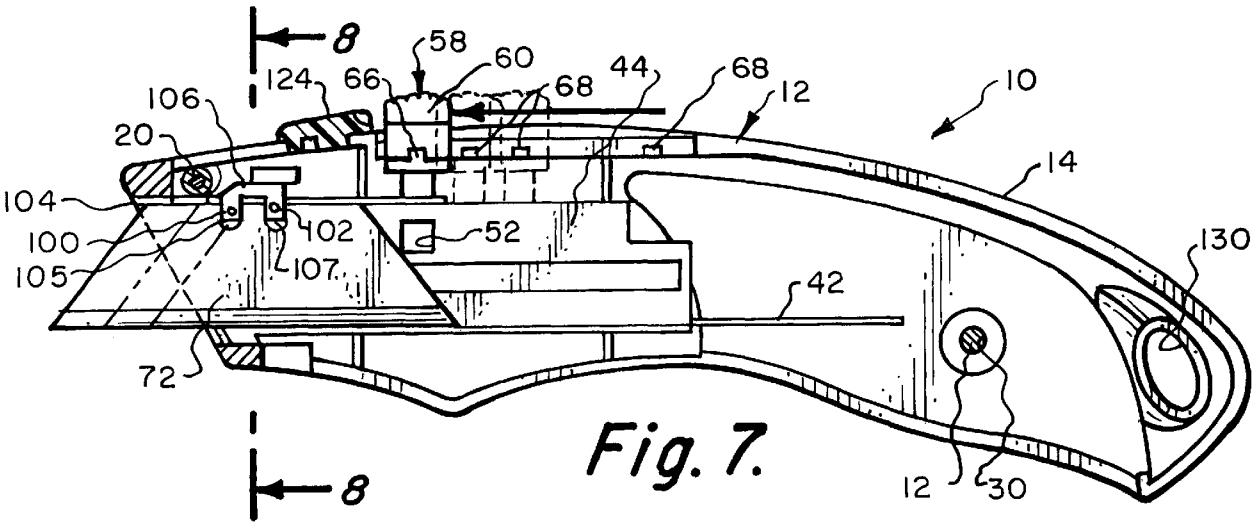
FIG. 7 is a view similar to FIG. 3 but showing an innermost blade in the extended position.
Figure 9:
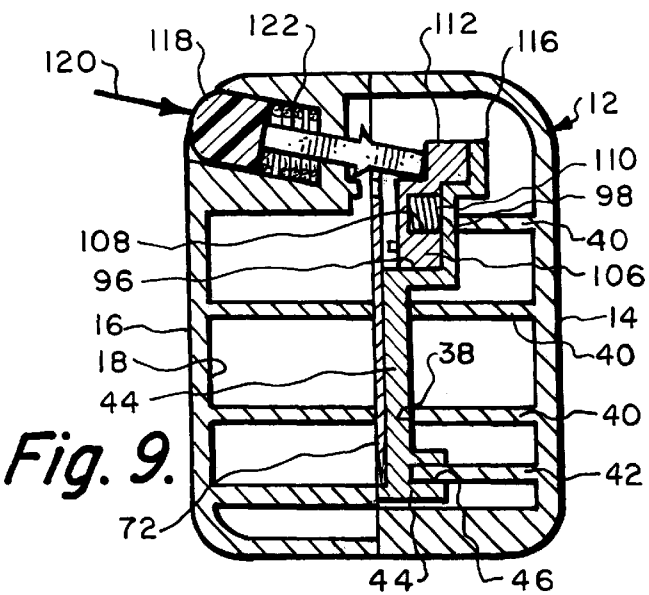
FIG. 9 is a cross-sectional view similar to FIG. 8 but showing the release button in the pressed position which is to cause the engaging block to disengage from the innermost blade of a stack of blades which permits the innermost blade to be removed and replaced with a new blade.
Figure 8:
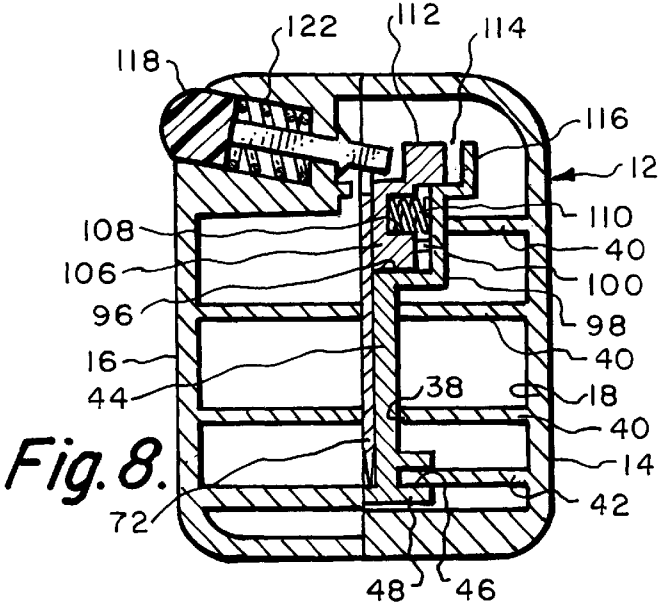
FIG. 8 is a transverse cross-sectional view taken along line 8—8 of FIG. 7 showing a release button in conjunction with the engaging block with the release button in its normal at rest position.
Figure 10:
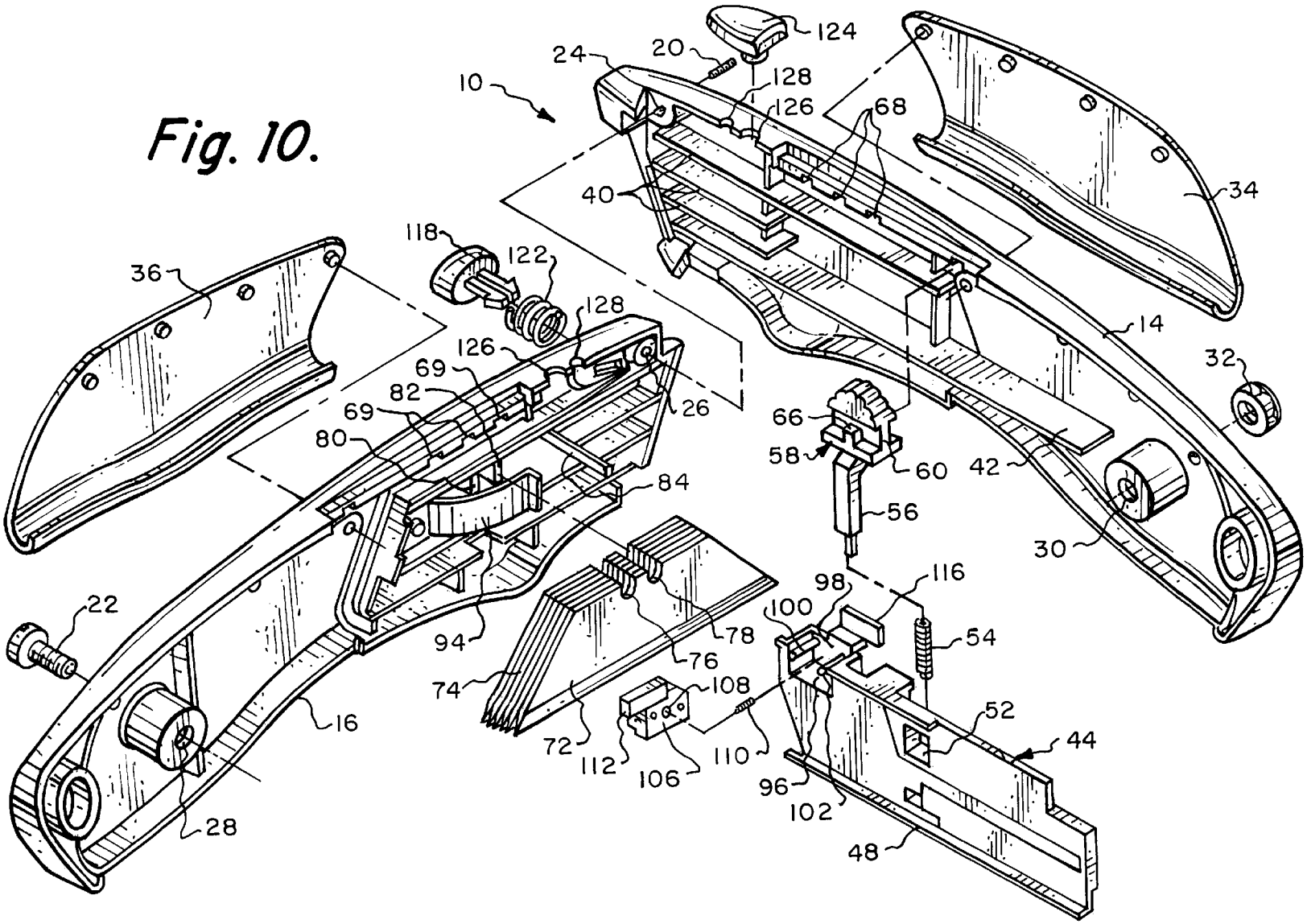
FIG. 10 is an exploded isometric view of the utility knife of the present invention.

Mounted on the pins 100 and 102 and located within the recess 96 is an engaging block 106. The engaging block 106 is capable of moving on the pins 100 and 102. The back surface of the engaging block 106 includes a cavity 108. Located within the cavity 108 is a coil spring 110. The outer end of the coil spring 110 is to abut against the back wall 98. Therefore, the engaging block 106 will be movable between an at-rest position where the engaging block 106 extends to be flush with the inner surface of the blade 72 and a non-engagement position which is where the engaging block 106 is spaced from the blade 72, as shown in FIG. 9. The at-rest position of the block 106 with the blade 72 is shown in FIG. 8. It is to be noted that the engaging block 106 is only able to connect with the innermost blade 72 and not with any other blade in the stack 74. Therefore, it is the engaging block 106 that functions in the capture and movement of the innermost blade 72 with the blade carrier 44 as such is moved linearly within the blade track 38 between the extended position, shown in FIG. 7, and the retracted position, shown in FIG. 3.

The fact that the mounting pins 100 and 102 are not aligned with the wall strip 42 prevents the engaging block 106 from turning or canting and will move in a straight line between the at-rest position, shown in FIG. 8, and the non-engagement position, shown in FIG. 9, against the action of the single coil spring 110. The engaging block 106 has an upper block 112. The upper block 112 is to be able to rest within a cavity 114 against an upstanding flange 116. The upper block 112, when the blade carrier 44 is in the forward most position, as shown in FIG. 7, and the innermost knife blade 72 protrudes from front opening 104 and protuberance 66 rests within the forward most notch 69 and protuberance 64 rests within the forward most notch 68, the inner end of a release button 118 is to be able to be pressed in the direction of arrow 120 against the bias of a coil spring 122 and come into contact with the upper block 112 causing the engaging block 106 to be moved from the engaging position of FIG. 8 to the non-engaging position of FIG. 9. This will now permit the innermost blade 72 to be manually moved through the front opening 104 and to be spaced from the housing 12. Normally, at this time the innermost blade 72 will be discarded as it probably will be dull. However, as the blade 72 is double sided, the blade 72 may be turned around and reinstalled in position within the opening 104 at which time the release button 118 will be released and the engaging block 106 will then be moved by the action of coil spring 110 to the at-rest position which will again reconnect the blade carrier 44 with the innermost blade 72.

If the innermost blade 72 is actually discarded, rather than just being turned around, when the thumb button is depressed to disengage from notches 68 and 69 and be manually moved to its rearward most position (rearward of the most rearward notches 68 and 69), the blade 74 that is closest to the blade carrier 44 will then be moved to assume the position of the innermost blade 72. Manual depressing of the thumb button 58 and sliding of such toward front opening 104 will result in that innermost blade 72 now protruding from the opening 104.

Figure 3:
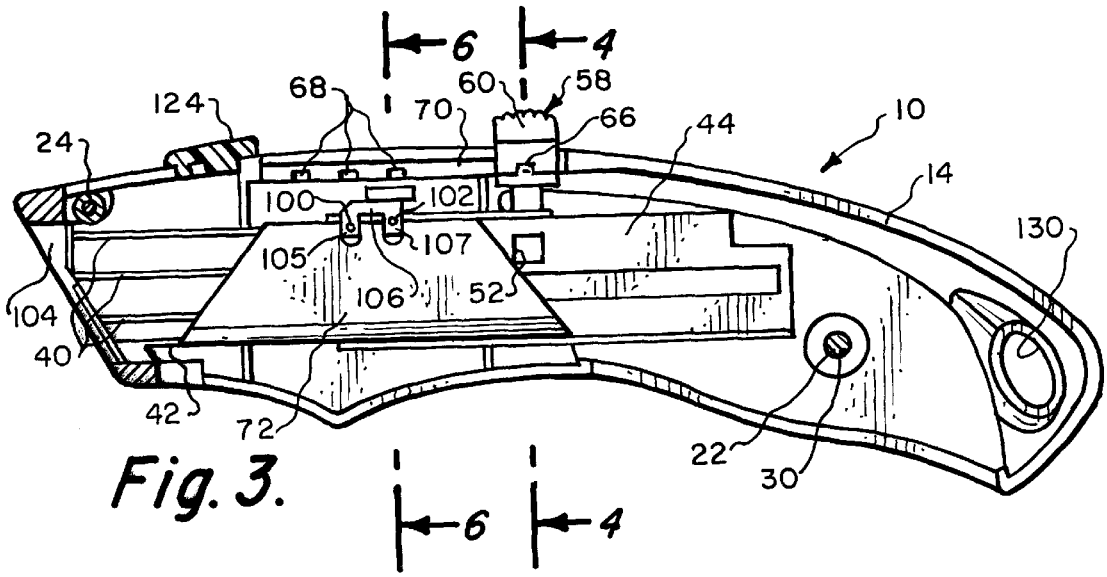
FIG. 3 is a longitudinal cross-sectional view through a housing of the utility knife of the present invention taken along line 3—3 of FIG. 2.
Figure 6:
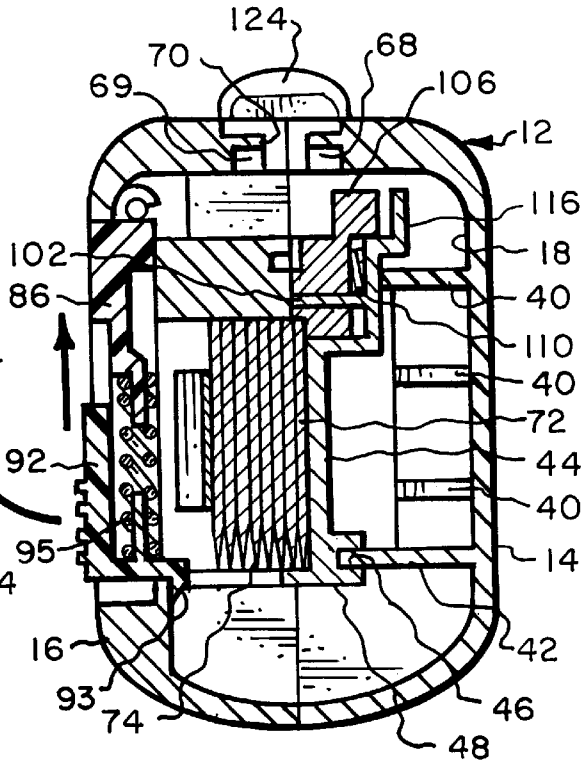
FIG. 6 is a transverse cross-sectional view taken along line 6—6 of FIG. 3 showing an engaging block that is mounted in conjunction with a blade carrier of the utility knife of the present invention.

It is to be understood that when the utility knife 10 of this invention is not being used, the innermost blade 72 should be in the retracted position, which is shown in FIG. 3. Only when the utility knife is intended to be used will the innermost blade 72 be moved to the protruding position with the innermost blade 72 to protrude the greatest amount when the protuberances 64 and 66 connect respectively with the forward most of the notches 68 and 69, the blade 72 protruding a medium distance amount when the protuberances 64 and 66 connect with the middle notches 68 and 69, and the innermost blade 72 protruding only a very slight amount when the protuberances 64 and 66 connect with the rearward most of the notches 68 and 69.

When the thumb button 58 is in the position shown in FIG. 7, the thumb button 58 is located directly adjacent a locator plug 124 that is mounted within a pair of holes 126 and 128 that is formed within the housing 12. The locator plug 124 is for the purpose of appearance plus it tells the user that when the user's thumb is in contact with the locator plug 124 that the blade 72 is fully extended. This could be helpful information especially if the utility knife 10 is being used within a dark environment. The back end of the housing 12 will also include a through hole 130 which will permit the utility knife 10 to be suspended from a nail (not shown) when the utility knife 10 is not being used.

What is claimed is:

1. A utility knife that protrudes a blade from a stored stack of blades comprising:

a housing having an internal chamber;

a blade track mounted within said internal chamber;

a blade-carrier mounted within said blade track, said blade carrier being movable in a linear direction between an extended position and a retracted position, said blade carrier adapted to retain a single blade with this blade to protrude from said housing when said blade carrier is in said extended position;

a thumb button connected to said blade carrier, said thumb button having an outer portion that is located exteriorly of said housing, said thumb button to be slidingly movable to cause said blade carrier to move between said retracted position and said extended position;

an engaging block mounted on said blade carrier, said engaging block being movable between an engaging position and a non-engaging position, with said engaging block in said engaging position the single blade is engaged by said engaging block and is movable along with said blade carrier between said extended position and said retracted position;

a pair of mounting pins mounted on said blade carrier, said engaging block being movably mounted on said mounting pins, said engaging block being biased by a single spring toward said engaging position; and a release button mounted on said housing, pressing of said release button when said blade carrier is in said extended position will cause said engaging block to be moved against said spring to said non-engaging position which will then permit extraction of said single blade from said housing.

2. The utility knife as defined in claim 1 wherein:

a line extending between said mounting pins being not in alignment with said linear direction, whereby said engaging block is prevented from canting relative to said blade carrier and is movable evenly and smoothly by said single spring relative to said blade carrier to insure that said engaging block will properly engage with said single blade.

3. The utility knife as defined in claim 2 wherein:

said thumb button having an inner portion, said inner portion being mounted within a receiving chamber formed in said blade carrier, said inner portion being laterally displaced from said outer portion in order to maximize space within a blade storage chamber which is to contain said stored stacked blades.

4. The utility knife as defined in claim 1 wherein:

said thumb button having an inner portion, said inner portion being mounted within a receiving chamber formed in said blade carrier, said inner portion being laterally displaced from said outer portion in order to maximize space within a blade storage chamber which is to contain said stored stacked blades.

* * * * *